US006223868B1

(12) United States Patent
Wullimann

(10) Patent No.: US 6,223,868 B1
(45) Date of Patent: May 1, 2001

(54) BRAKE MECHANISM FOR DEVICE FOR HAULING UP/DOWN BY ROPE

(75) Inventor: Frank Wullimann, Bellach (CH)

(73) Assignee: Rollgliss AG (CH)

( * ) Notice: Subject to any disclaimer, the term of this patent is extended or adjusted under 35 U.S.C. 154(b) by 0 days.

(21) Appl. No.: 09/092,957

(22) Filed: Jun. 8, 1998

(30) Foreign Application Priority Data

Jun. 9, 1997 (EP) ..... 97810359

(51) Int. Cl.[7] ..... A65H 59/16

(52) U.S. Cl. ..... 188/188; 188/65.1; 192/105 B; 254/267; 254/391; 187/350

(58) Field of Search ..... 188/65.1, 65.4, 188/65.5, 188, 65.2; 192/105 B, 103 A; 254/267, 391; 187/350, 373

(56) References Cited

U.S. PATENT DOCUMENTS

| | | | | |
|---|---|---|---|---|
| 1,198,926 | * | 9/1916 | Kemp | 188/65.1 |
| 2,811,228 | * | 10/1957 | Borden | 188/189 |
| 3,669,223 | * | 6/1972 | Arnold | 188/188 |
| 4,198,033 | | 4/1980 | de la Messuziere et al. . | |
| 4,432,437 | * | 2/1984 | McClung | 182/234 |
| 4,729,456 | * | 3/1988 | Sugiyama | 188/65.1 |
| 4,923,037 | * | 5/1990 | Stephenson et al. | 188/188 |
| 5,060,758 | * | 10/1991 | Ishioka | 182/234 |
| 5,127,490 | * | 7/1992 | Sheu | 182/5 |
| 5,738,339 | * | 4/1998 | Kuryu | 254/267 |
| 5,911,410 | * | 6/1999 | Wullimann | 254/334 |

FOREIGN PATENT DOCUMENTS

| | | |
|---|---|---|
| 0480117 | 4/1992 | (EP) . |
| 97 17107 | 5/1997 | (WO) . |

* cited by examiner

*Primary Examiner*—Robert J. Oberleitner
*Assistant Examiner*—Bradley King
(74) *Attorney, Agent, or Firm*—Mau & Krull, P.A.

(57) ABSTRACT

A brake mechanism for a device for hauling up/down by rope, in particular one for the safe hauling up and down by rope of persons and loads. The device has a pulley which preferably has a back stop that prevents the pulley from turning during the roping down. The rope brake mechanism has a rope speed measuring device that cooperate with a rope brake, which acts upon the rope to exert a braking force onto the rope when the rope speed increases above a maximum predetermined speed.

25 Claims, 3 Drawing Sheets

BRAKE MECHANISM FOR DEVICE FOR HAULING UP/DOWN BY ROPE

CROSS-REFERENCE TO RELATED APPLICATION

This application claims the priority of European Patent Application No. 97810359.6 filed Jun. 9, 1997, the subject matter of which is incorporated herein by reference.

BACKGROUND OF THE INVENTION

The present invention relates to a brake mechanism for a device for hauling up/down by rope, in particular one for the safe hauling up and down by rope of persons and loads. The device has a pulley which preferably has a back stop that prevents the pulley from turning during the roping down.

In accordance with the European published patent EP-A-0 480 117 by the applicant, such devices for hauling up/down by rope are preferably used for hauling persons or loads up and down on a rope. The preferred area of application is for rescue services or in general as mobile equipment. The devices for hauling up/down by rope essentially function to reduce the retaining force during the roping down in connection with a safety to prevent an uncontrolled dropping of the person or load attached to the rope.

These known devices for hauling up/down by rope have a large-volume pulley equipped with a back stop. In most cases, a rope is placed with 2.5 windings around this pulley. The device is operated such that when pulling up, the pulley is running freely and represents only a low resistance. During the roping down, on the other hand, the pulley is blocked by the back stop and the rope slides over the surface of the pulley. The resulting friction takes over a large portion of the load attached to the rope.

As a safeguard during the roping down, the International Patent Application WO-A-9 717 107 suggests providing a self-activating rope stop on the pull side of the device for hauling up/down by rope. The advantage of this arrangement is that the rope stop only needs to take over a portion of the load since the device for roping up/down accepts the largest portion of the pull.

However, the disadvantage of this solution is that upon reaching the critical roping down speed, the roping down operation is stopped completely. In particular if a roping down speed near the permissible limit, e.g. 2 m/s, is required, a brief exceeding of this speed limit can trigger the stopping of the rope.

SUMMARY OF THE INVENTION

It is the object of the present invention to specify a device, which prevents an increase in the roping down speed above a predetermined limit value during the roping down operation.

In accordance with the present invention, the rope brake mechanism comprises rope speed measuring means that cooperates with a rope brake, which acts upon the rope to exert a braking force onto the rope when the rope speed increases above a maximum predetermined speed.

A brake mechanism is installed on the pull side of a device for hauling up/down by rope, which mechanism forces the engagement of a frictional brake on the rope, preferably only during the roping down, if a predetermined rope speed is exceeded. In particular, the brake mechanism increases the braking effect of the frictional brake with increasing rope speed, so that the roping down speed does not reach an unacceptable, uncontrollable speed, even for heavy loads.

The present invention relates to a device for raising and lowering a load, and the device includes a pulley and a brake mechanism. A rope is wound about the pulley, and the brake mechanism acts upon the rope to exert a braking force on the rope when the rope speed increases above a maximum predetermined speed. The break mechanism includes at least two flyweights and at least one bearing surface. The rotatable arrangement of flyweights is operatively connected to the pulley and rotates about an axis in response to rotation of the pulley. The bearing surface is operatively connected to the flyweights and is movable against the rope in response to rotation of the flyweights. When the pulley is rotated, the centrifugal force exerted on the flyweights is transferred axially to the bearing surface, which causes an increased braking effect on the rope. The braking effect increases with increasing rotational speed.

The flyweights surround a rotatable core in a symmetrical arrangement, and from the core originates a radial guide means. The radial guide means holds the flyweights such that they can be moved radially. The arrangement of flyweights is surrounded peripherally by a spring-elastic element, which biases the flyweights toward the core. In addition, a frictional wheel bears against the rope and is linked to the flyweights, and a gear is arranged between the frictional wheel and the flyweights in order to establish a gear ratio, as well as a rotational link.

The rope moves through an essentially tube-shaped rope guide proximate the pulley, and the width of the rope guide can be changed. The rope guide includes convexities and concavities to force the rope into an increasingly S-shaped course during the reduction of the width so as to increase the braking effect on the rope. At least a section of the rope guide is movable so as to allow the change in width for the rope guide, and the movable section can be moved by a coupling means. The coupling means include contact zones that are angled relative to the rotational axis of the flyweights to convert radial movement of the flyweights to a movement of the coupling means directed along the rotational axis.

DETAILED DESCRIPTION OF THE PREFERRED EMBODIMENT

The design of the actual device for hauling up/down by rope corresponds to the design described in the WO-A-9 717 107, the subject matter of which is incorporated into the description by reference.

Figure 1:
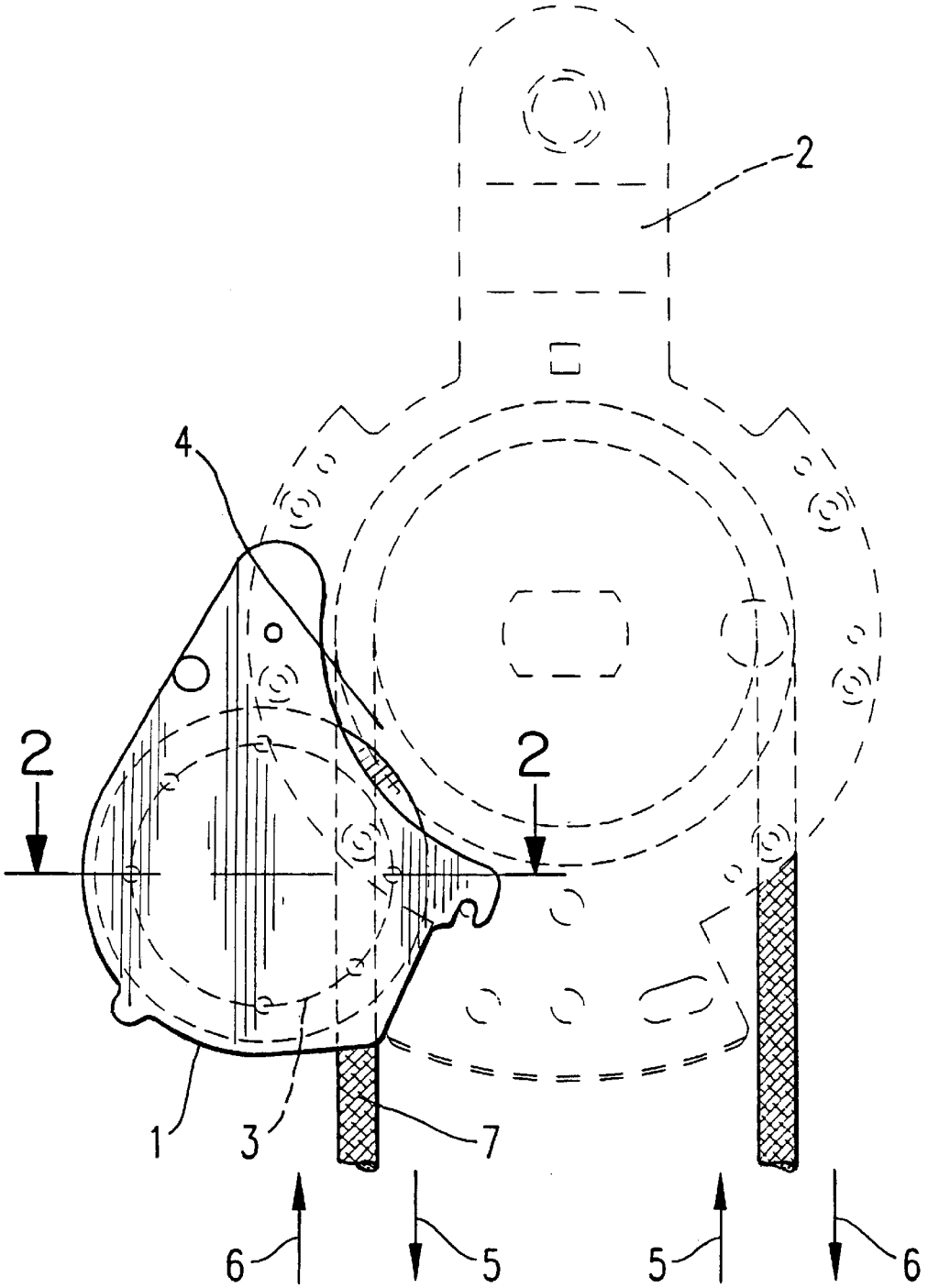
FIG. 1 is a top view from above of a device for hauling up/down by rope, which device has the brake mechanism according to the invention.
Figure 2:
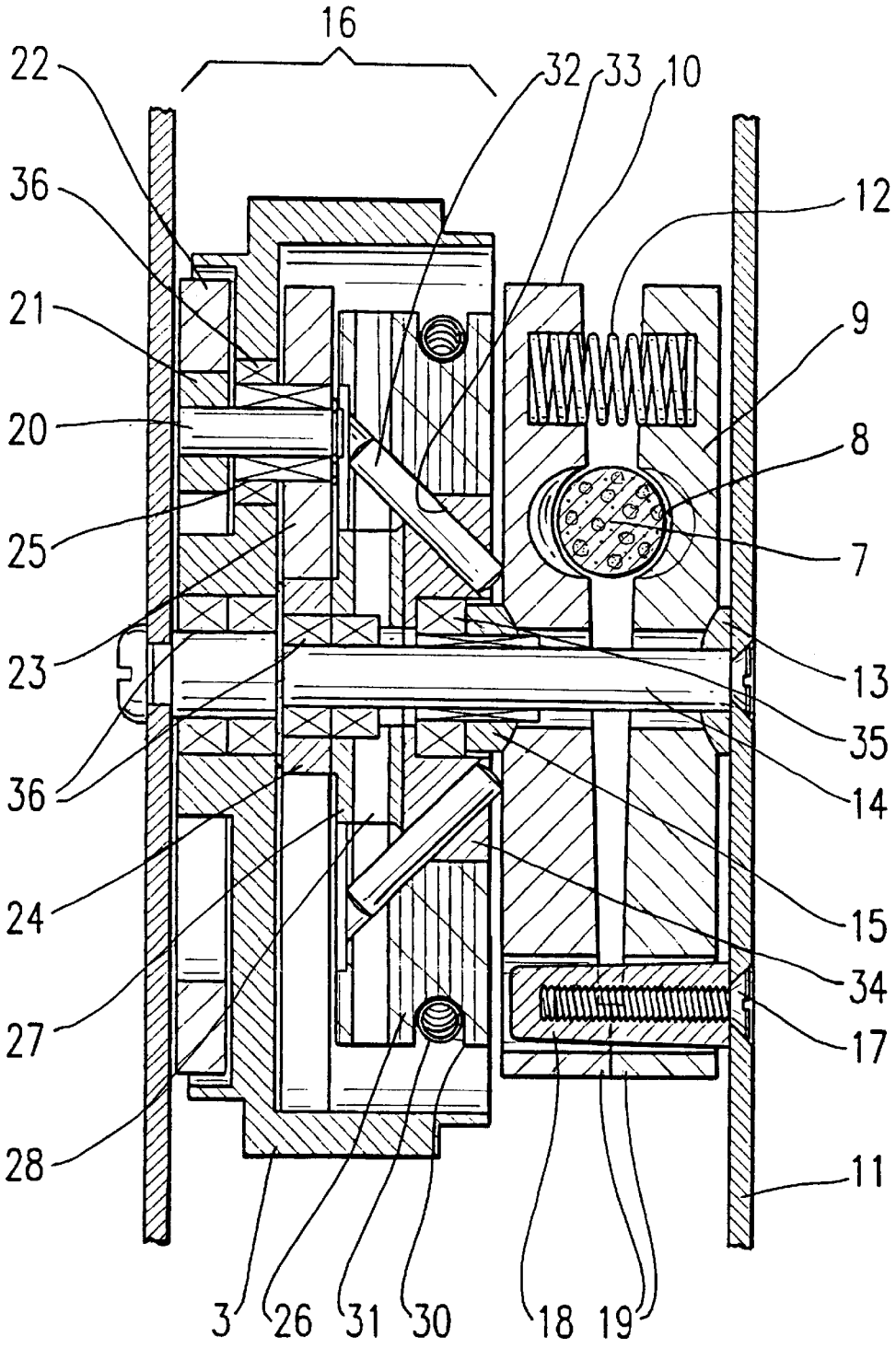
FIG. 2 is a section through the brake mechanism according to II—II in FIG. 1.
Figure 3:
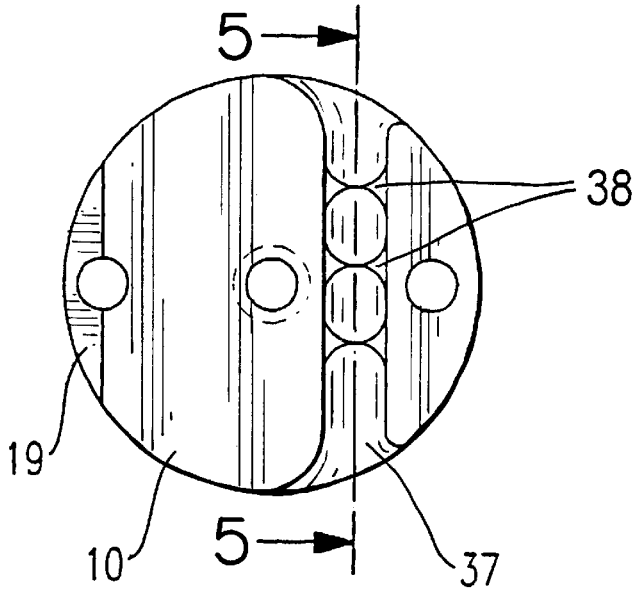
FIG. 3 is a top view of a brake jaw for the rope brake of the brake mechanism.

FIG. 1 shows a rope brake mechanism 1 according to the invention on a device 2 for hauling up/down by rope, e.g. a device according to the WO-A-9 717 107. The rope brake mechanism 1 comprises a frictional wheel 3 with knurled running surface, which is pressed against a rope 4. The frictional wheel 3 moves in roping up 5 direction as well as roping down 6 direction. The pull end 7 of the rope passes through a rope guide 8 (see FIG. 2), which consists of two jaws 9, 10, having an essentially mirror-inverted design (FIG. 3). The stationary jaw 9 in this case is fixedly connected to the housing 11, while the other jaw 10 can be moved.

In the position shown here, the two jaws 9, 10 are pushed by a spring 12 into the opened resting position. In this position, the guide 8 is opened to the maximum and has the largest cross section, so that the rope 7 essentially glides without resistance through the guide.

The jaws 9, 10 are held on the one hand by a fixed cone 13 or a cone 15 that can be displaced along the axis 14 and is coupled with the centrifugal unit 16 while, on the other hand, the jaws are secured against turning by a screw 17. A bolt 18 with internal thread is screwed onto the screw 17, which bolt extends through the bore at the back end of the brake jaws 9, 10, near the plateaus 19, and has a slightly conical shape to allow a movement of the brake jaw 10. During the braking operation, the movable jaw 10 tilts slightly over the front edges of the plateau if the movable cone 15 is moved by the centrifugal unit in the direction of the fixed cone 13.

The centrifugal unit 16 consists of the frictional wheel 3, inside of which a shaft 20 is positioned such that it can rotate. A planet pinion 21 fits on the outer end of shaft 20 and meshes with a fixed toothed ring 22 with internal toothing. An additional, inside planet pinion 23 fits on the other end of the shaft 20 and meshes with the central gear 24. This planet pinion 23 is attached to the shaft 20 by means of a freewheel mechanism 25. The freewheel mechanism blocks during the roping down, so that the center gear 24 is put in motion via the frictional wheel 3 and the planet gear, consisting of toothed ring 22 and the toothed gears 21 and 23.

In roping up direction, the freewheel mechanism 25 uncouples the two toothed gears 21 and 23, so that the center gear 24 is not driven and the frictional wheel can move freely, without problems and at any speed without causing a braking of the rope.

As a rule and to prevent the parts 26 that react to the centrifugal force from being too heavy or too large, it is advantageous to have a transmission, so that the speed of the center gear, for example, is 8 times higher than that of the frictional wheel 3.

The center gear 24 is fixedly connected to the core 27, into which core radially outward-pointing pins 28 are inserted. A sector-shaped flyweight 26 is positioned on each pin 28, in such a way that it can glide. The flyweights have respectively one bore 29 for one pin 28 for this.

Figure 4:
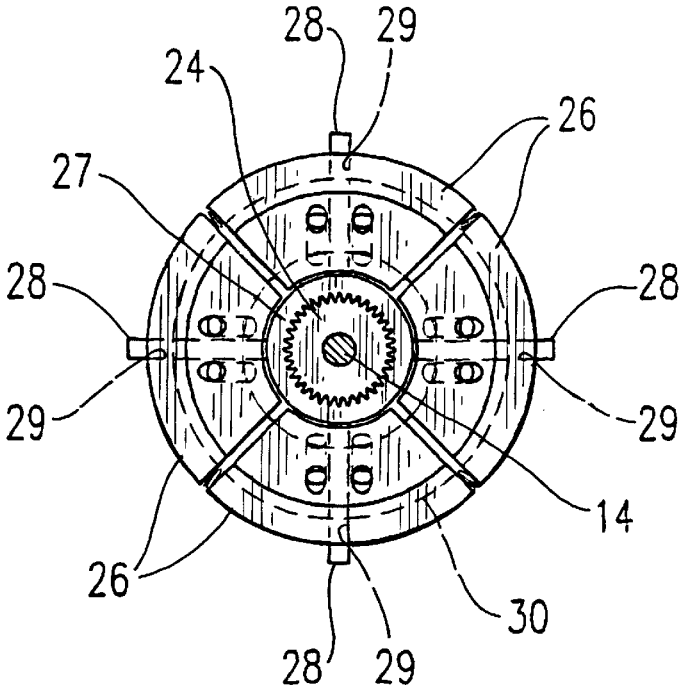
FIG. 4 is a top view of the centrifugal unit.

The 4 flyweights 26 surround the core 27 in a symmetrical arrangement (FIG. 4), wherein each covers a 90° sector. A spiral spring 31, positioned inside groove 30 on the outside, keeps the flyweights pushed against the core 27 and forms the antagonistic force to the centrifugal force.

Respectively two pins 32 are inserted at an angle into the flyweights 26 and project from the flyweights 26 in the direction of axis 14. The pins 32 glide inside bores 33 in the thrust collar 34. Finally, the movable cone 15, positioned rotatably on a rolling bearing 35, sits on the thrust collar.

All rotating parts of the centrifugal unit are positioned with little friction in suitable bearings 36 on the axis 14. Shaft 20 is positioned in the same way inside frictional wheel 3. Pins 32 and pins 28 are composed of steel, which ensures good gliding qualities in the flyweights 26 of brass and the thrust ring 34 that is also made of brass.

Figure 5:
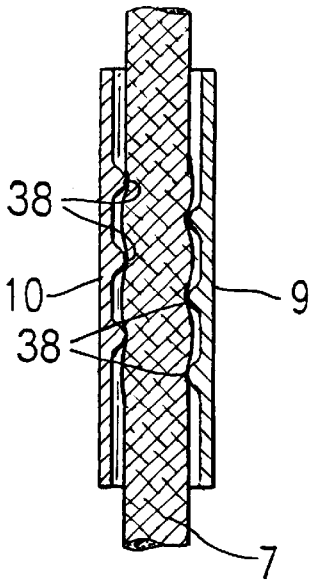
FIG. 5 is a section along the rope guide formed by the brake jaws, according to V—V in FIG. 3, in the position where the brake jaws are pressed together.

During the roping down, the rope 4 puts into motion the frictional wheel 3 and, via the planet gear, also the core 27 and the surrounding flyweights 26 since the freewheel mechanism 25 blocks in this direction. Starting with a certain speed, the flyweights 26 start to move toward the outside, against the force of spiral spring 31, or to exert a net force directed toward the outside onto the pins 32. The pins 32 convert this movement and force, directed toward the outside, into an axially directed force onto the pressure disk and thus the cone 15. The cone 15 pushes the movable jaw 10 in the direction of the fixed jaw 9 and thus narrows the cross section of guide 8, as a result of which an increasingly stronger frictional braking force is exerted onto the pull end 7 that is positioned inside the guide 8. In addition, convexities 38 are located inside grooves 37 in jaws 9, 10, which jaws together form the guide 8, so that the rope 7 is forced into an increasingly S-shaped course inside the guide 8 (FIG. 5), which further increases the friction.

It is a common design criteria for the brake mechanism to avoid roping down speeds exceeding 2 m/s for a load of 150 kg. The operating threshold and strength of the brake is achieved through a suitable selection of the various component parts, such as transmission of the planet gear 21–24, weight of the flyweights 26, strength and characteristic of the spiral spring 31, form of the brake jaws 9, 10 and the guide 8, etc.

It will be understood that the above description of the present invention is susceptible to various modifications, changes and adaptions, and the same are intended to be comprehended within the meaning and range of equivalents of the appended claims.

For example, it is conceivable to use a combination of conical and tapered surfaces in place of the angled pins 32, possibly by also using roll bodies. With higher requirements, e.g. for higher loads, the blocking effect of the freewheel mechanism 25 can be overtaxed. However, it is possible to provide more than one planetary shaft 20 with, respectively, one freewheel mechanism 25, as a result of which the load will be distributed over the existing freewheel mechanisms. It is furthermore conceivable to have a different number of flyweights with a different form or different angle. Also, a different material can be selected for producing the flyweights and pins 32 and pins 28, as long as displacement on the latter is ensured.

What is claimed is:

1. A device for raising and lowering a load, comprising:

a frame;

a pulley rotatably mounted on said frame;

a rope wound about said pulley;

at least two flyweights operatively connected to said pulley and rotatable about a flyweight axis in response to rotation of said pulley relative to said frame;

at least one bearing surface operatively connected to said flyweights and movable against said rope in response to rotation of said flyweights; and a coupling means, interconnected between said flyweights and said bearing surface, for converting centrifugal force on said flyweights into axially directed force against said bearing surface, thereby causing an increased braking effect on said rope as a function of rotational speed of said flyweights, wherein said coupling means includes contact zones that are angled relative to said flyweight axis and convert radial movement of said flyweights into axial movement of said coupling means.

2. The device of claim 1, wherein said pulley rotates about a different axis than said flyweight axis.

3. The device of claim 1, further comprising a rope guide through which said rope is pulled proximate said pulley, said rope guide having a variable width, said rope guide having convexities and concavities to force said rope into an increasingly S-shaped course during a reduction of width so as to increase a braking effect on said rope.

4. The device of claim 3, wherein at least a section of said rope guide is movable to allow a change in width of said rope guide, and wherein said movable section is movable by a coupling means.

5. A device for raising and lowering a load, comprising:

a frame;

a pulley rotatable mounted on said frame;

a rope wound about said pulley;

at least two flyweights operatively connected to said pulley and rotatable about a flyweight axis in response to rotation of said pulley relative to said frame;

a frictional wheel which bears against said rope and is linked to said flyweights; and at least one bearing surface operatively connected to said flyweights and movable against said rope in response to rotation of said flyweights, wherein said flyweights impose an axially directed force against said bearing surface.

6. The device of claim 5, further comprising a gear interconnected between said frictional wheel and said flyweights.

7. The device of claim 5, wherein a one way clutch is interconnected between said wheel and said flyweights to facilitate relatively higher speed raising of the load.

8. A device for raising and lowering a load, comprising:

a frame;

a pulley rotatable mounted on said frame;

a rope wound about said pulley;

at least two flyweights operatively connected to said pulley and rotatable about a flyweight axis in response to rotation of said pulley relative to said frame, wherein said flyweights surround a rotatable core in a symmetrical arrangement and are movable along guides which extend radially from said core, and wherein said flyweights are surrounded peripherally by a spring-elastic element that biases said flyweights against said core; and at least one bearing surface operatively connected to said flyweights and movable against said rope in response to rotation of said flyweights, wherein said flyweights impose an axially directed force against said bearing surface.

9. A device for raising and lowering a load, comprising:

a frame;

a pulley rotatably mounted on said frame;

a rope wound about said pulley;

at least two flyweights operatively connected to said pulley and rotatable about a flyweight axis in response to rotation of said pulley relative to said frame;

a spring wrapped around said flyweights to resist centrifugal force acting upon said flyweights; and at least one bearing surface operatively connected to said flyweights and movable against said rope in response to rotation of said flyweights, wherein said flyweights impose an axially directed force against said bearing surface.

10. A device for raising and lowering a load, comprising:

a pulley;

a rope routed around said pulley;

at least two flyweights operatively connected to said pulley and rotatable about a flyweight axis in response to rotation of said pulley;

at least one bearing surface operatively connected to said flyweights and movable against said rope in response to rotation of said flyweights; and means, interconnected between said flyweights and said bearing surface, for converting a centrifugal force acting on said flyweights into an axially directed force acting on said bearing surface, wherein said means includes contact zones that are angled relative to said flyweight axis to convert radial movement of said flyweights into axial movement of said means toward said bearing surface.

11. The device of claim 10, wherein said flyweights surround a rotatable core in a symmetrical arrangement and are movable along guides which extend radially from said core, and wherein said flyweights are surrounded peripherally by a spring-elastic element that biases said flyweights against said core.

12. The device of claim 10, wherein said pulley rotates about a different axis than said flyweight axis.

13. The device of claim 10 further comprising a spring, said spring being wrapped around said flyweights to provide resistance from a centrifugal force.

14. The device of claim 10, wherein a frictional wheel bears against said rope and is linked to said flyweights.

15. The device of claim 14, further comprising a gear interconnected between said frictional wheel and said flyweights.

16. The device of claim 14, wherein a one way clutch is interconnected between said wheel and said flyweights to facilitate relatively higher speed raising of the load.

17. The device of claim 10, further comprising a rope guide through which said rope is fed proximate said pulley, said rope guide having a variable width, said rope guide having convexities and concavities to force said rope into an increasingly S-shaped course during a reduction of width so as to increase a braking effect on said rope.

18. The device of claim 17, wherein at least a section of said rope guide is movable to allow a change in width of said rope guide, and wherein said movable section is movable by a coupling means.

19. A method of limiting rope descent of speed, comprising the steps of:

providing a pulley;

routing a rope about the pulley;

providing at least two flyweights for rotation about a flyweight axis;

linking rotation of the flyweights to rotation of the pulley;

providing a bearing member adjacent the rope and between the rope and the flyweights;

providing a thrust member between the flyweights and the bearing member for movement along the flyweight axis, wherein bearing surfaces are provided on the thrust member and the flyweights, and the bearing surfaces are angled relative to the flyweight axis; and linking the flyweights to the bearing member in such a manner that the bearing member presses against the rope as a function of rotational velocity of the flyweights.

20. The method of claim 19, wherein a circumferential groove extends about the flyweights, and further comprising the step of providing a spring in a closed loop and disposed in tension within the groove.

21. The method of claim 19, wherein the pulley is provided for rotation about a pulley axis, rather than the flyweight axis.

22. The method of claim 19, wherein rotation of the flyweights is linked to rotation of the pulley by a wheel disposed radially adjacent the pulley, and the bearing member is disposed adjacent a linearly extending portion of the rope.

23. The method of claim 19, wherein the flyweights are linked to the pulley by a wheel bearing against the rope.

24. The method of claim 23, wherein a one-way clutch is operatively interconnected between the flyweights and the wheel.

25. The method of claim 23, wherein the flyweights and the wheel are linked in a manner which causes the flyweights to rotate relatively faster than the wheel.

* * * * *

UNITED STATES PATENT AND TRADEMARK OFFICE

CERTIFICATE OF CORRECTION

PATENT NO. : 6,223,868 B1
DATED : May 1, 2001
INVENTOR(S) : Frank Wullimann

It is certified that error appears in the above-identified patent and that said Letters Patent is hereby corrected as shown below:

Column 6,
Line 45, delete [of] after "descent".

Signed and Sealed this

Thirteenth Day of November, 2001

*Attest:*

Nicholas P. Godici

*Attesting Officer*

NICHOLAS P. GODICI
*Acting Director of the United States Patent and Trademark Office*